United States Patent [19]

Algire

[11] 4,414,912

[45] Nov. 15, 1983

[54] BURGLAR ALARM

[76] Inventor: Charles W. Algire, 4730 Dunkirk Ave., Baltimore, Md. 21229

[21] Appl. No.: 380,860

[22] Filed: May 21, 1982

Related U.S. Application Data

[63] Continuation of Ser. No. 187,577, Sep. 15, 1980, abandoned.

[51] Int. Cl.[3] ..... G08B 17/02

[52] U.S. Cl. ..... 116/5; 116/78; 116/86; 116/16; 116/100

[58] Field of Search ..... 116/5, 95, 86, 78, 16, 116/17, 15, 87, 148, 215, 100

[56] References Cited

U.S. PATENT DOCUMENTS

| | | | |
|---|---|---|---|
| 787,358 | 4/1905 | Day | 116/87 |
| 1,419,954 | 6/1922 | Brichetto | 116/78 |
| 1,798,207 | 3/1931 | Koeune . | |
| 2,546,463 | 3/1971 | Lustig . | |
| 2,561,743 | 7/1951 | Kusharowis . | |
| 2,601,839 | 7/1952 | Kucewicz . | |
| 4,098,509 | 7/1978 | Van Krevelen . | |
| 4,203,383 | 5/1980 | Hill | 116/5 |

*Primary Examiner*—Charles E. Frankfort
*Assistant Examiner*—Denis E. Corr
*Attorney, Agent, or Firm*—Walter G. Finch

[57] ABSTRACT

The invention is an improved burglar alarm for doors and windows or other similar openings in an enclosure to be protected against secretive entry. The invention consists of a series or plurality of bell-like devices which are automatically dumped or knocked to the floor when entry is made, thus creating an alarm noise. The alarm is operable on doors or windows that swing or slide, or which open inwardly or outwardly. The alarm is of simple construction and easy to install, consisting of a plurality of bell-like elements, a supporting rod, mounting apparatus for the supporting rod, and a wiper member for certain mounting positions.

11 Claims, 11 Drawing Figures

BURGLAR ALARM

This is a continuation application of Ser. No. 187,577, filed Sept. 15, 1980 now abandoned.

BACKGROUND AND SUMMARY OF THE INVENTION

The invention relates to alarms, and particularly to burglar alarms. Specifically, the invention relates to burglar alarms for doors and windows or other similar openings in an enclosure that is to be protected against a stealthy or secretive entry.

A need has existed for a long time for a burglar alarm that was simple to construct, simple to install, and simple to set. This burglar alarm invention meets those criteria.

The alarm consists of a plurality or series of bell-like means or devices which are automatically dumped or knocked to the floor when entry is made, thus creating an alarm noise.

The alarm is operable on doors or windows that swing or slide, or which open inwardly or outwardly.

The alarm consists of the aforementioned plurality or series of bell-like means or devices, a supporting rod or arm means, means for mounting the supporting rod means, and a wiper means for certain mounting positions.

On doors that open inwardly, the supporting rod means is affixed to the door casing header above the door so that the supporting rod means clears the top of the door. With the door closed, the plurality or series of bell-like alarm means or devices are then mounted or placed on the supporting rod means so as to hang downwardly as an obstruction to a freely swinging door opening inwardly. When the door is opened, the bell-like means or devices are pushed off of the supporting rod means by the door and fall to the floor noisily, thus sounding the alarm.

For doors that open outwardly, the supporting rod means is affixed to the top portion of the inside surface of the door so that it clears the door opening as the door is opened. The supporting rod means is mounted or affixed on the door at a position close to the side door jamb that is opposite to the hinge side. A wiper means is installed or affixed on the aforementioned side door jamb in a position so that the supporting rod means will enter freely and project through the wiper means as the door is closed. With the door closed the plurality or series of bell-like alarm means or devices are then mounted or placed on the supporting rod means so that they hang downwardly. When the door is opened the supporting rod means withdraws from the wiper means, through which it had passed as the door was closed, and the bell-like means or devices are wiped or pushed off of the supporting rod means by the wiper means; the bell-like means or devices falling to the floor noisily, thus sounding the alarm.

For doors or windows that open by sliding in a track means, the alarm is installed and operates in a similar manner. The supporting rod means is affixed to the side jamb, from which the door or window slides away from, so that the supporting rod means projects in front of and parallel to the surface of the door or window. The wiper means is affixed to the door, near the top, or to the top horizontal frame portion of the window sash, so that the wiper means will encircle the supporting rod means as the sliding door or window is closed. The plurality or series of bell-like means or devices are mounted or placed on the supporting rod means so that they hang downwardly. As in the case of the door opening outwardly, as the sliding door or window is slid sideways to open it, the wiper means wipes or pushes the bell-like means or devices from the support means and they fall noisily to the floor, thus sounding the alarm.

For casement-type windows that open inwardly, the alarm is mounted and operated the same as for doors that open inwardly.

For casement-type windows that open outwardly, the alarm is mounted and operated the same as for doors that open outwardly.

For swinging type windows, top or bottom hinged, inwardly or outwardly swinging, the alarm is mounted and operated similarly to the mountings and operation for doors that open inwardly or outwardly except that for bottom hinged swinging windows the supporting rod means is mounted on the sash of the window, near the top edge, opposite the hinged side. For the bottom hinged windows opening inwardly, as the window is opened the supporting rod means moves through an arc and points downwardly, thus permitting the plurality or series of bell-like means to slide off of the supporting rod means and fall noisily to floor, thus sounding the alarm.

For double-hung windows, the supporting rod means is affixed to the side of the lower sash, near the top, so that the supporting rod means points downwardly. The wiper means is affixed to the side window frame so that the wiper means encircles the supporting rod means near the bottom or end of the supporting rod means, when the window is closed. To set the alarm, the plurality or series of bell-like means are mounted or placed on the supporting rod means while the lower sash is open and held there manually as the lower sash is closed. When the end of the supporting rod means enters the wiper means, the manual support of the bell-like means or devices can be withdrawn as the wiper means will now retain the bell-like means or devices. When the lower sash is raised to a position where the supporting rod means is withdrawn from the wiper means, the plurality of bell-like means will fall to the floor, thus sounding the alarm.

For an alarm on the upper sash of a double-hung window, the supporting rod means is affixed to the side of sash, near the top, with the supporting rod means pointing upwardly. The wiper means is affixed to the side window frame so as to encircle the supporting rod means near the point where supporting rod means is affixed to the sash. With the window closed, the plurality of bell-like means or devices are placed on the supporting rod means. As the upper sash is opened (moved downwardly) the wiper means pushes or wipes the bell-like means or devices off of the supporting rod means as the supporting rod means withdraws from the wiper means as the upper sash moves downwardly.

It is to be noted, that in the case of the upper sash, the installation of the alarm means thereon may restrict the opening of the window sash, top and/or bottom sash, to the full extent, depending upon the configuration of the sash clearance.

The bell-like means can be removed from the supporting rod means during the time when normal use is made of the doors and/or windows and the alarm means is not required.

It is, therefore, an object of the invention to provide a burglar alarm means for both doors and windows.

It is also an object of the invention to provide a burglar alarm means that can be used on doors that open inwardly or outwardly, or that slide sideways to open.

It is also an object of the invention to provide a burglar alarm means that can be used on sliding, casement, swinging, or double-hung windows.

It is still another object of the invention to provide a burglar alarm that is simple to construct.

It is yet another object of the invention to provide a burglar alarm that is simple to install.

It is yet still another object of the invention to provide a burglar alarm that is simple to set.

Further objects and advantages of the invention will become more apparent in the light of the following description of the preferred embodiment.

DESCRIPTION OF THE PREFERRED EMBODIMENTS

Figure 1:
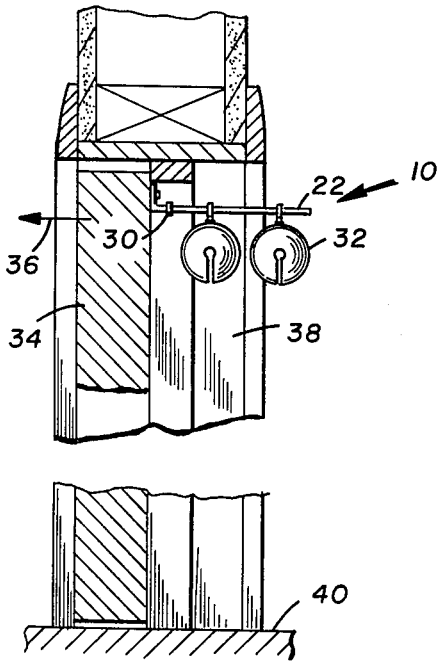
FIG. 1 is a cross sectional view through a door opening outwardly, showing a burglar alarm mounted thereon, with the door closed.
Figure 2:
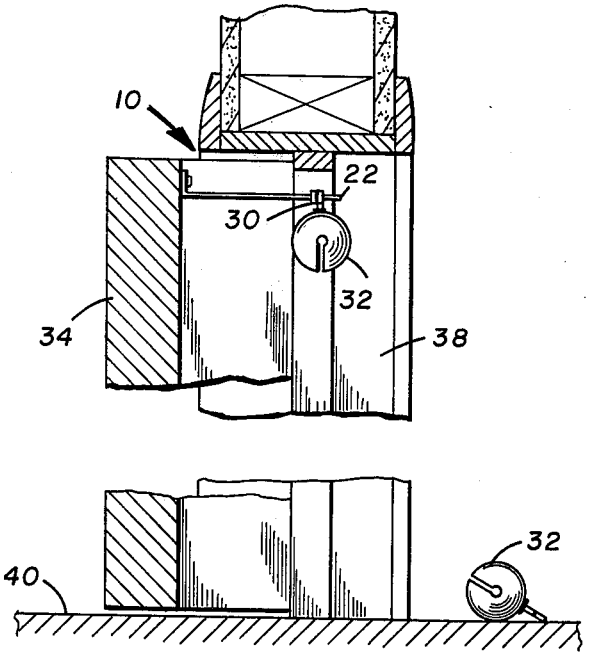
FIG. 2 is a cross sectional view through a door opening outwardly, showing a burglar alarm mounted thereon, with the door in a partial open position to activate the alarm.
Figure 3:
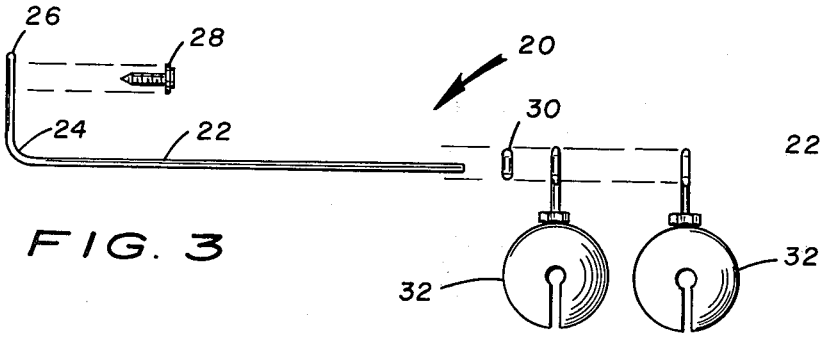
FIG. 3 is an exploded side view of the burglar alarm shown in FIGS. 1, 2, and 5.
Figure 5:
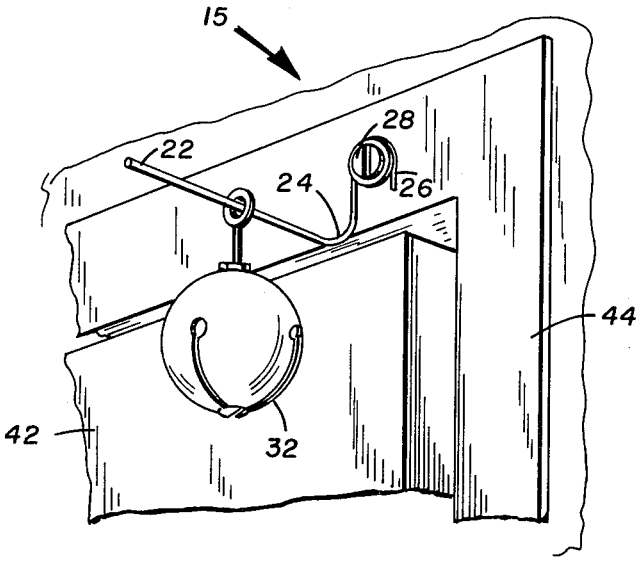
FIG. 5 is a partial pictorial view of a door or casement window opening inwardly, with the door casement window in a partially opened position to activate the alarm.
Figure 6:
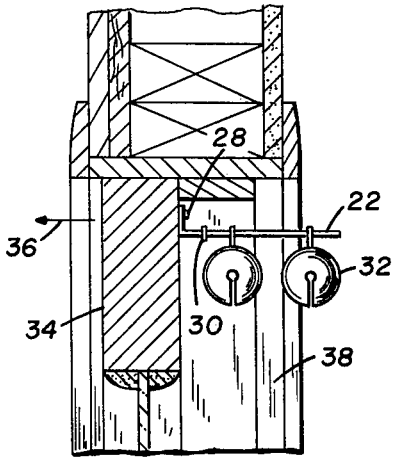
FIG. 6 is a partial cross sectional view through a casement window opening outwardly, showing a burglar alarm mounted thereon, with the window closed.
Figure 7:
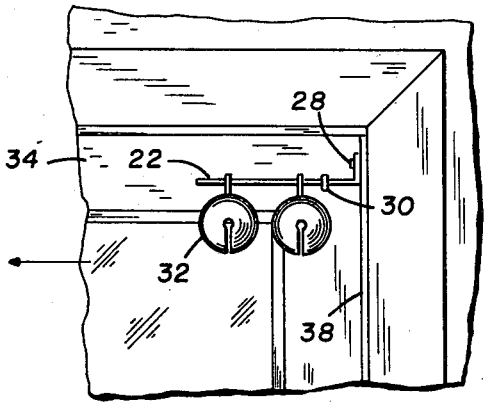
FIG. 7 is a partial cross sectional view through a door or window sliding sideways, showing a burglar alarm mounted thereon.
Figure 8:
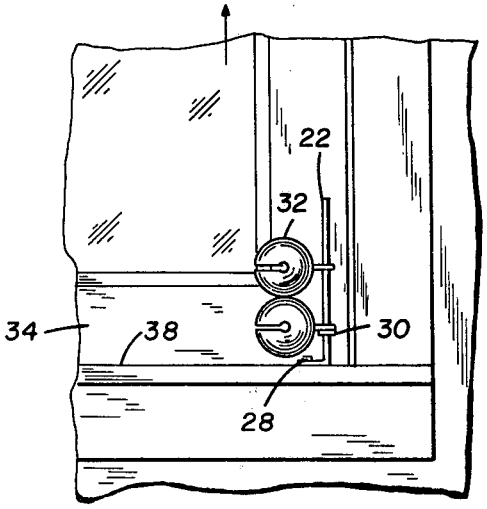
FIG. 8 is a partial cross sectional view through the lower sash of a double hung window, showing a burglar alarm mounted thereon.
Figure 9:
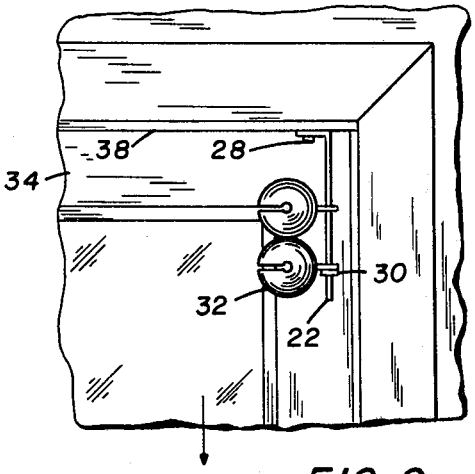
FIG. 9 is a partial cross sectional view through the upper sash of a double hung window, showing a burglar alarm mounted thereon.
Figure 10:
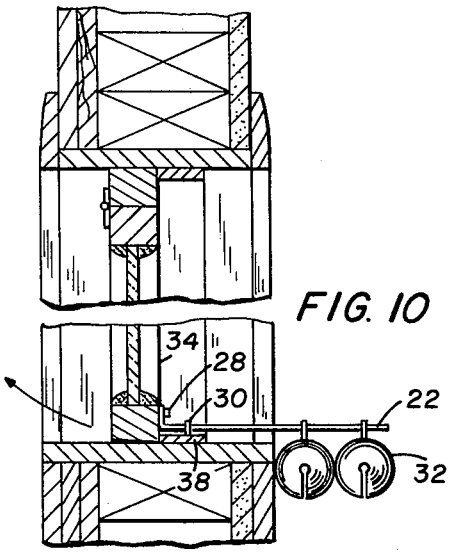
FIG. 10 is a partial cross sectional view of a window hinged at the top, opening outwardly, showing a burglar alarm mounted thereon.
Figure 11:
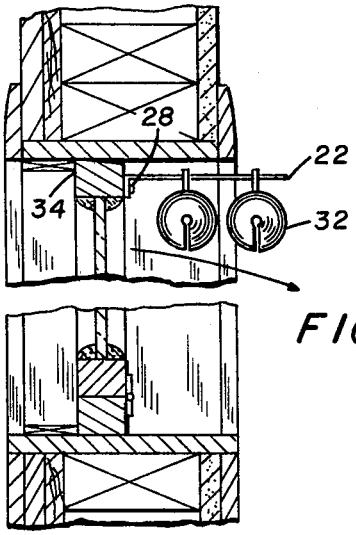
FIG. 11 is a partial cross sectional view of window hinged at the bottom, opening inwardly.

Referring to the drawings and particularly to FIGS. 1, 2, 3, and 5, a burglar alarm is shown: at 10 in FIG. 1 for a door opening outwardly, with the door in closed position and the alarm set; at 10 in FIG. 2 for a door opening outwardly, with the door in a partially opened position to activate the alarm; at 15 in FIG. 5 for a door opening inwardly, with the door in a partially opened position to activate the alarm; and at 20 in FIG. 3 in an exploded side view to show the components of the alarm means.

Referring now to FIG. 3, the burglar alarm of this invention consists of: a supporting rod or arm means 22; a mounting or fastening means 28 for affixing or mounting the supporting rod means 22 at the opening to be protected by the alarm; a plurality of bell-like means or devices 32 for mounting or placing on the supporting rod means, the bell-like means or devices 32 causing the alarm when the alarm is activated; and a wiper means 30 that is required for certain installations, as described in the Background and Summary of the Invention and as referred to hereinafter, in order to activate the alarm in those referenced installations.

Regarding the components of the burglar alarm 20, the supporting rod means 22 may be round, square, or any other configuration that can be suitably formed for the component. The supporting rod means 22 may be metal or any other suitable material that is rigid enough for the task and can be suitably formed into the configuration.

Figure 4:
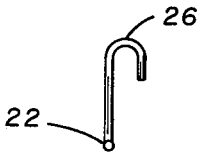
FIG. 4 is an end view of a portion of FIG. 3.

The supporting rod or arm means 22 is bent or formed at an approximate right angle 24 near one end, as shown in FIG. 3, and then further bent or formed into a loop or eye 26 at the distal end of the right angle 24 bent or formed portion, as shown in FIG. 4. The loop or eye 26 may be "U" shaped as shown or may be further formed into a more or less circle or eye-type loop. The loop or eye 26 is used for mounting or affixing the supporting rod 22 to a door, window, or frame as described hereinbefore and hereinafter.

It is to be noted that the supporting rod means 22 may be considered the same as a supporting arm means 22 or a supporting bracket means 22, each constructed in the same configuration.

The supporting rod means 22 is affixed to a door or window assembly as shown in FIGS. 1, 2, and 5, and as described in more detail in the Background and Summary of the Invention of this specification. It is to be understood that all of the referenced installation and use assemblies covered in the Background and Summary of the Invention hereinbefore, are embodiments that relate to the embodiments descriptions described in the Description of the Preferred Embodiments herein; the installations and operations being substantially the same, varying only in the directional positioning of the supporting rod means 22 and the base upon which the supporting rod means 22 is affixed (door, sash, or frame), and in certain instances the varying position where a wiper means 30 is used and installed. Those referenced installation and use assemblies, covered in the Background and Summary of the Invention, are thus incorporated in this Description of the Preferred Embodiments without further reference thereto see FIGS. 6 through 11.

Turning now to FIGS. 1, 2, and 5 for a detailed description of the installation: FIG. 1 shows an installation on an outwardly opening door 34, which also depicts the general arrangement of an outwardly opening window, with the door 34 (or window) in a closed position; FIG. 2 shows the same installation as FIG. 1, but with the door 34 (or window) in a partially opened position and in the process of activating the alarm means 10, see also FIG. 6 for the window; FIG. 5 shows an installation of an inwardly opening door 42, which also depicts the general arrangement of an inwardly opening window, with the door 42 (or window) in a partially opened position and in the process of activating the alarm means 15.

It is to be understood that the alarm means 10 and 15, separately referenced for the differently described installations, are each the same burglar alarm means as the burglar alarm means 20 shown in an exploded side view in FIG. 3. The separate reference numbering is for the purpose of maintaining a clarity in the description of the various uses of a single alarm means.

In FIG. 1 the door 34 (or window) opens outwardly in the direction of the arrow 36. The supporting rod means or arm 22 is affixed to the door 34 (or window) by the mounting or fastening means 28 being passed through the loop or eye 26 and secured to the door 34 (or window). The wiper means 30, which is required for this mode of installation, is affixed to the frame 38 in a position so as to encircle the supporting rod 22. When the alarm 10 is to be set, the plurality or series of bell-like means 32 are placed on the supporting rod means 22 by slipping the loop or eye portion of the bell-like means 32 over the rod, so that the bell-like means 32 hang downwardly.

It is to be noted that the mounting or fastening means 28 for mounting, fastening or affixing the support rod 22 to some base from which the alarm will be operated, may be a screw, a screw with a large flange-like cap under the screw head, normally monolithic or integral with the screw head, or may be a washer and a screw.

It is also to be noted that the wiper means 30 is a screw eye or any means similar to a screw eye which can be affixed in position so that the eye portion will encircle the supporting rod means 22. As shown in FIGS. 1, 2, and 3, the screw or fastening portion of the wiper means 30 is pointed away from the observer so that it does not show and only the eye portion is seen on end. As described hereinbefore, a wiper means 30 is not required on installations such as that shown in FIG. 5.

It is also to be noted that bell-like means 32, which cause the alarm sound when the burglar alarm 10, 15, or 20 is activated, may be of any type. So called "sleigh bells" have been illustrated, but so called "cow bells" or other similar noises makers may be used and it is to be understood that such variations are within the scope and intent of this invention.

Regarding the references to a plurality or series of bell-type means 32, only two are illustrated in FIGS. 1, 2, and 3, and only one in FIG. 5. It is to be understood that any number of such bell-type means 32 may be used, or even a single bell-type means 32 if desired, and such a variation is also within the scope and intent of this invention. FIG. 1, showing two bell-type alarm means 32, is shown with the alarm 10 set for operation with the bell-type means 32 in position on the supporting rod means 22. FIG. 2 shows the alarm 10 being activated as the door 34 (or window) is opened, one of the bell-type means 32 has already been wiped or pushed off of the supporting arm 22 and has dropped noisily to the floor 40. In a like manner FIG. 5 shows the alarm 15 being activated as the door 42 (or window) is opened, only one bell-type means 32 is shown as the others (one or more) have been pushed off by the door 42 pushing against them as it is opened. In the latter arrangement no wiper means 30 is required as hereinbefore described.

Note that the bell-type means 32 have some facility for hanging them on the support rod means 22. The sleigh bell types illustrated have an eye-bolt type of hanging means, however, this may also be a loop-type handle (such as on a cow bell), a swivel eye, or any other type hanger loop-like means. Such variations are within the scope and intent of this invention.

In FIG. 5 the support rod means 22 is shown affixed to the door casing or frame header 44 (or similar window framing or header) with the horizontal portion of the support rod means 22 extended just clear of the door 42 (or window). The support rod means 22 is affixed to the frame header 44 by having the fastening means 28 suitably affixed through the loop or eye 26 and into the frame header 44.

As can be readily understood from the foregoing description of the invention, the present structure can be configured in different modes to provide the ability to establish a burglar alarm for doors, windows, and other means of entry.

Accordingly, modifications and variations to which the invention is susceptible may be practiced without departing from the scope and intent of the appended claims.

What is claimed is:

1. An alarm system, comprising:

a base means;

a support means, said support means being of a rod-like configuration, said support means having one end of said rod-like configuration further formed into a loop-like eye configuration, said loop-like eye being used to facilitate affixing said support means to said base means, said support means being of a single configuration;

a fastening means, said fastening means being used to permanently affix said support means to said base means, said fastening means being passed through said loop-like eye configuration and permanently inserted into said base means, said fastening means permanently securing said support means to said base means during period of use and recurring reuse of said alarm system;

an alarm means, said alarm means being capable to causing bell-like sounds, said alarm means being slideably and removably placed upon said support means, said alarm means being operated to cause said bell-like sounds when said alarm means is causably stripped from said support means;

a wiper means;

and a holding means, said wiper means being of eye-like configuration and having a mounting means affixed thereto, said wiper means being located and affixed in position on said holding means, said holding means being adjacent to and separate from said base means, said wiper means being affixed to said holding means by said mounting means, said wiper means being so located and affixed to said holding means so that said rod-like support means, affixed to said base means, will slideably and removably enter and pass into and partially through said eye-like wiper means, said wiper means causably stripping said alarm means from said support means when said alarm means is activated by the movement of said support means, said alarm means consisting of at least one sleigh bell of substantially spherical shape to cause said bell-like sounds.

2. An alarm system as recited in claim 1 and additionally, a loop-like eye means, said loop-like eye means being affixed to said alarm means, said loop-like eye means being the means by which said alarm means is slideably and removably placed upon said support means.

3. An alarm system as recited in claim 2, wherein said alarm means is a plurality of sleigh bells of substantially spherical shape, said bell-like objects causing said bell-like sounds when said alarm system is operated by said alarm means being causably stripped from said support means.

4. The alarm system as recited in claim 1, wherein said alarm means is usable when said support means is installed and affixed in position on a door opening outwardly from an enclosure for said door, said door being said base means, and said holding means being an abutment means for said door on a door jamb adjacent to said door.

5. An alarm system as recited in claim 3, wherein said alarm system is usable when installed and affixed in position on a door frame of a door opening inwardly into an enclosure for said door, said door frame being said base means, said door causably stripping said alarm means from said support means.

6. An alarm system as recited in claim 3, wherein said alarm system is usable when installed and affixed in position on an interior door frame of an enclosure of a door opening by being slidable sideways, said door frame being said base means, and said door being said holding means.

7. An alarm system as recited in claim 1, wherein said alarm system is usable when said support means is installed and affixed in position on a window sash opening outwardly from an enclosure, said window sash being said base means, and additionally a window abutment means, said wiper means being installed on said window abutment means, with said window abutment means being said holding means.

8. An alarm system as recited in claim 1, wherein said alarm system is usable when installed and affixed in position on a window frame of a window sash opening inwardly into an enclosure, said window frame being said base means.

9. An alarm system as recited in claim 1, wherein said alarm system is usable when installed and affixed in position on a window frame of a window sash opening by being slideable sideways, said window frame being said base means, with said window sash being said holding means.

10. An alarm system as recited in claim 1, wherein said alarm system is usable when said support means is installed and affixed in position on a window frame of a double-hung type window having double-hung sash, said double-hung window sash opening by being slideable vertically upward, with said window frame being said base means, and said wiper means being installed on said double-hung window sash, with said double hung window sash being said holding means.

11. An alarm system as recited in claim 1, wherein said alarm system is usable when said support means is installed and affixed in position on a window frame of a double-hung type window having double-hung sash, said double-hung window sash opening by being slidable vertically downward, said window frame being said base means and said wiper means being installed on said double-hung window sash, with said double-hung window sash being said holding means.

* * * * *